US006648198B2

(12) United States Patent
Demers

(10) Patent No.: US 6,648,198 B2
(45) Date of Patent: Nov. 18, 2003

(54) VACUUM BELT CONVEYOR

(75) Inventor: Sylvain Demers, St. Louis de France (CA)

(73) Assignee: Voith Paper Patent GmbH, Heidenheim (DE)

( * ) Notice: Subject to any disclaimer, the term of this patent is extended or adjusted under 35 U.S.C. 154(b) by 71 days.

(21) Appl. No.: 10/010,809

(22) Filed: Nov. 13, 2001

(65) Prior Publication Data

US 2003/0089756 A1 May 15, 2003

(30) Foreign Application Priority Data

Nov. 14, 2000 (DE) ..... 200 19 346

(51) Int. Cl.[7] ..... B65H 20/00
(52) U.S. Cl. ..... 226/95; 34/117
(58) Field of Search ..... 226/95, 170, 174; 34/117, 120

(56) References Cited

U.S. PATENT DOCUMENTS

| | | | | |
|---|---|---|---|---|
| 3,355,349 A | | 11/1967 | Devlin | 162/286 |
| 3,425,610 A | | 2/1969 | Stewart | 226/95 |
| 4,298,277 A | * | 11/1981 | Silverberg | 226/95 X |
| 4,336,813 A | | 6/1982 | Seragnoli | 131/84 |
| 4,495,746 A | | 1/1985 | Focke et al. | 53/389 |
| 4,716,909 A | | 1/1988 | Belvederi et al. | 131/84.1 |
| 4,883,074 A | | 11/1989 | Mattei | 131/84.1 |
| 5,355,593 A | | 10/1994 | Kotitschke | 34/117 |
| 5,551,171 A | | 9/1996 | Dahl | 34/625 |
| 5,595,334 A | * | 1/1997 | Belec et al. | 226/95 X |
| 5,706,994 A | * | 1/1998 | Welch et al. | 226/95 |
| 5,782,009 A | | 7/1998 | Kotitschke | 34/117 |
| 5,810,350 A | | 9/1998 | Pollich | 271/276 |
| 5,857,605 A | * | 1/1999 | Welch et al. | 226/95 |
| 6,405,914 B1 | * | 6/2002 | Broom et al. | 226/95 |
| 6,443,443 B1 | * | 9/2002 | Hirth et al. | 226/170 X |
| 2001/0050154 A1 | * | 12/2001 | Broom et al. | 226/95 X |

FOREIGN PATENT DOCUMENTS

| | | | |
|---|---|---|---|
| DE | 4040485 | 7/1992 | 5/24 |
| DE | 199 00 986 A1 | 7/2000 | B65H/23/04 |
| DE | 299 10 850 | 11/2000 | B65H/20/10 |
| DE | 199 62 731 A1 | 6/2001 | B65G/15/58 |
| DE | 100 09 188 A1 | 8/2001 | B65H/20/10 |
| GB | 2 187 172 | 9/1987 | B65H/20/10 |

OTHER PUBLICATIONS

Fibron Machinery Corporation of New Westminster, BC, Canada, brochure entitled "Double–Tail Elimination" published at least before Nov. 13, 2001.

* cited by examiner

*Primary Examiner*—Emmanuel M. Marcelo
(74) *Attorney, Agent, or Firm*—Taylor & Aust, P.C.

(57) ABSTRACT

A vacuum belt conveyor includes an air-pervious endless belt, a first pulley positioned at the upstream end of the conveyor and a second pulley positioned at the downstream end of the conveyor, the pulleys guiding the belt when the belt is traveling. The endless belt comes into contact with a plate having openings which are connected to a source of negative pressure. The belt, in the area of the upstream end of the conveyor, is in contact with a curved and perforated guiding surface, with the perforations, being connected to a source of negative pressure.

13 Claims, 3 Drawing Sheets

VACUUM BELT CONVEYOR

BACKGROUND OF THE INVENTION

1. Field of the Invention

The present invention relates to a vacuum belt conveyor, and, more particularly, to a vacuum belt conveyor for the conveyance of a web.

2. Description of the Related Art

Reference is made to the following documents: DE 299 10 850; U.S. Pat. No. 3,355,349; Brochure "Double-Tail-Elimination of the Fibron Machinery Corporation, New Westminster, BC, Canada; DE 199 62 731; DE 199 00 986; DE 100 09 188, which are incorporated herein and made a part hereof. In German Patent 299 10 850 a vacuum belt conveyor is disclosed which includes an air pervious endless belt traveling across two pulleys and a vacuum box. Negative pressure of a vacuum box propagates through the conveying run of the belt in order to draw a web or "tail", to be guided by the conveyor belt, by suction. One of the pulleys is displaceable in order to tension the belt.

According to U.S. Pat. No. 3,355,349, at the infeed or upstream end of the conveyor, a severing device or tail cutter is arranged which includes a toothed knife extending transversely to the pulley axis. Before the belt conveyor begins to convey the tail of a web, the complete web, including the tail, is running (e.g. from a last drying cylinder) downwardly, passing the infeed end of the belt conveyor and finally entering into a waste bin or waste pulper. A small "tail doctor" is provided at the last drying cylinder for peeling the tail from the dryer shell and for transferring the tail onto the belt conveyor. When the latter is beginning to operate the tail cutter severs the tail thus forming a new beginning of the tail which is conveyed to the calender. If no tail cutter is present the belt conveyor repulls a "double tail" upwardly from the waste bin causing problems during the threading operation. Reference is made to the above mentioned brochure "Double-Tail Elimination".

According to DE 199 62 731, an improvement has been proposed including an infeed tray. This results in a more reliable operation of the belt conveyor, even with increased working speed. However, there is existing a need for further improvements in the way mentioned hereinbefore.

SUMMARY OF THE INVENTION

It is an object of the present invention to provide an improved conveying apparatus which will operate reliably with various paper grades, even with paper grades of high strength, and in modem paper making or finishing machines operating at extremely high speed (e.g. more than 2000 meters per minute).

It is a further object of the present invention to eliminate a tail doctor at the web-delivering roll or cylinder, and to avoid the use of a tail cutter and an infeed tray.

Another object of the invention is an improved design which allows the upstream end of the conveyor closer to a web-delivering surface (e.g. surface of a roll or cylinder) than was previously practiced.

The aforementioned objects, as well as further objects that are presented later, are attained by the features defined herein.

According to the present invention, a belt conveyor further includes a curved and perforated guiding surface for the air-pervious endless belt. The guiding surface is arranged at the upstream end of the conveyor; having the perforations of the guiding surface outwardly open toward the endless belt and inwardly open toward a source of negative pressure.

In operation, the curved and perforated guiding surface acts as a suction pickup area which is placed very close to the traveling path of the web, e.g. close to a web-delivering surface (fabric, felt, roll or cylinder). Thus, the web or tail, in particular a new beginning of the tail, can be transferred onto the conveyor belt in a much shorter time than hitherto possible.

An advantage of the present invention allows the suction pickup area of the vacuum belt conveyor to come directly into contact with the web traveling path so that the tail, in particular a new beginning of the tail, can be transferred directly onto the conveyor belt.

Another advantage of the present invention allows the tail of the web, preferably a new beginning of the tail, to be peeled off from the surface of a roll or cylinder, by at least one marginal nozzle. Immediately thereafter, the tail is picked up by the conveyor belt in the area of the curved and perforated guiding surface.

Yet another advantage of the present invention is an improved threading process in paper machines is obtained, without the need for a tail doctor at the web delivering roll or cylinder. Furthermore, the vacuum belt conveyor does not need an infeed tray. In many cases, a tail cutter may also be avoided.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
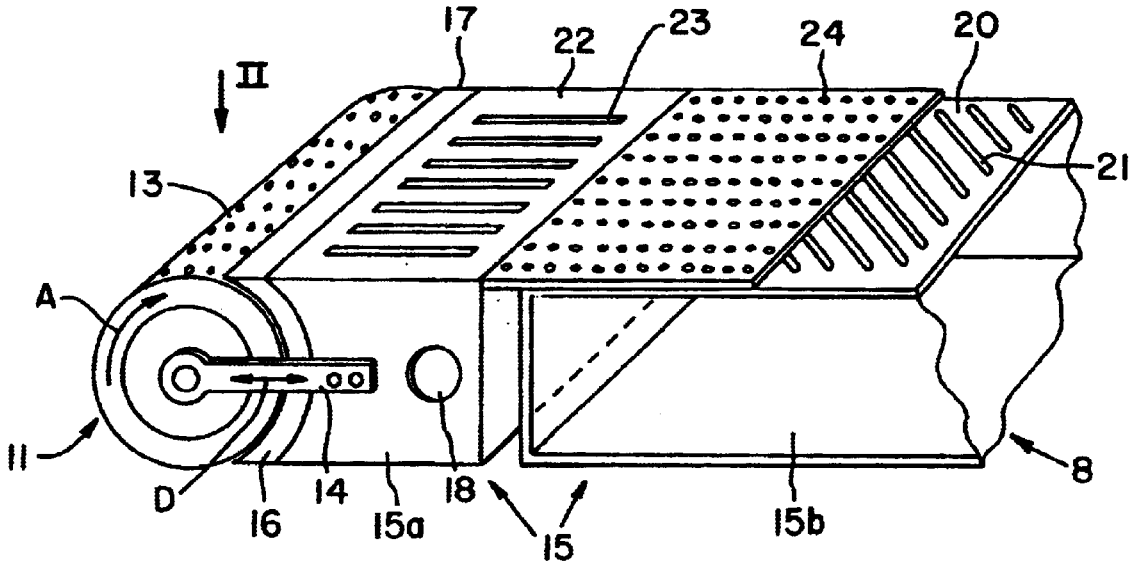
FIG. 1 is a partially sectioned perspective view of the upstream end of a vacuum belt conveyor according to the present invention.
Figure 2:
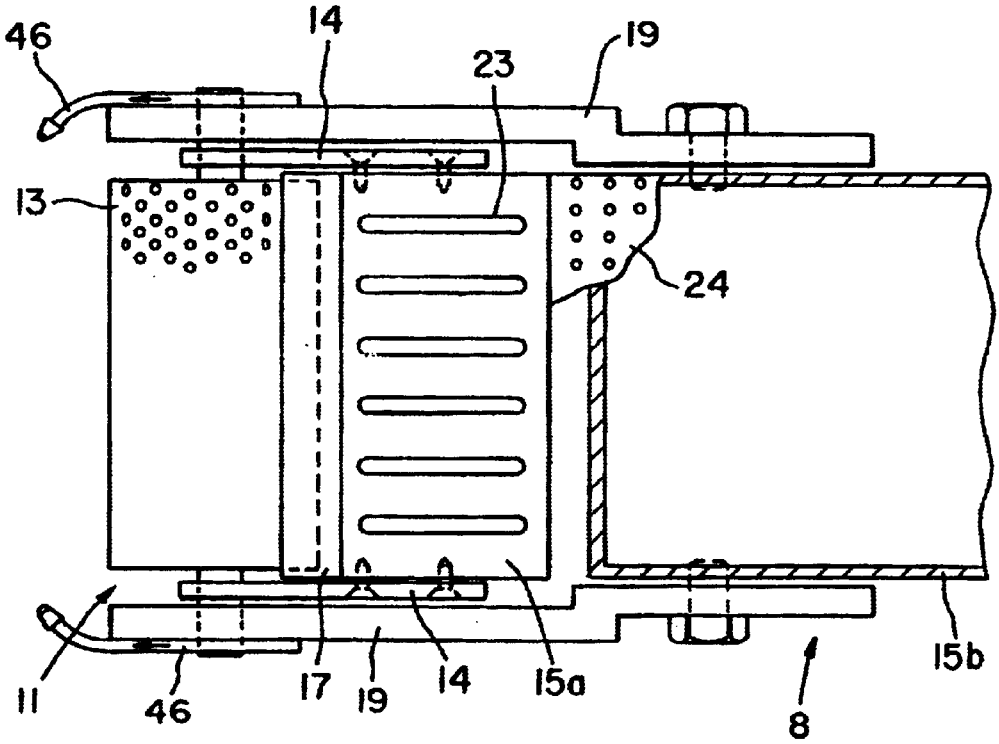
FIG. 2 is a view along arrow II of FIG. 1.

Referring now to the drawings, and more particularly to FIGS. 1 and 2, there is shown a vacuum belt conveyor 8 including a first pulley 11 positioned at the upstream end of the conveyor. An air-pervious endless belt and the downstream end of the conveyor (including a second pulley) are not shown.

First pulley 11 has a perforated shell 13 and is rotatably supported by two bearing shields 14 which are rigidly connected to an upstream section 15*a* of a vacuum box 15.

Vacuum box 15 is subdivided into upstream section 15*a* and downstream section 15*b*. In operation, pulley 11 rotates clockwise as shown by arrow 'A' and the endless belt travels accordingly.

Figure 5:
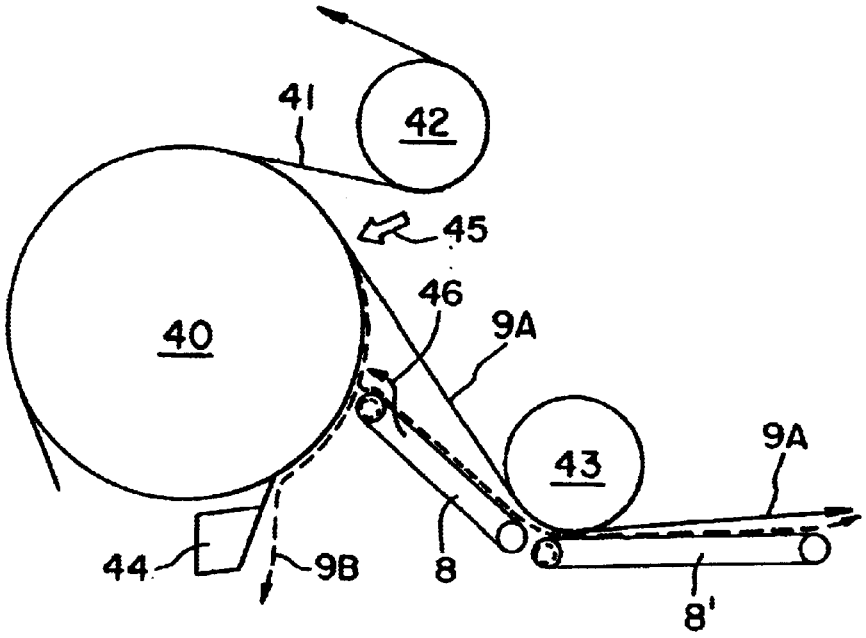
FIG. 5 illustrates a situation in a paper making machine wherein a vacuum belt conveyor is provided.

Upstream section 15*a* of vacuum box 15 is open toward perforated shell 13 of first pulley 11. Sealing elements 16 and 17 are provided between shell 13 and section 15*a*. In operation, a negative pressure is created within upstream section 15*a* by connecting it via vacuum inlet 18 to an external source of negative pressure, not shown. The negative pressure propagates through perforations of shell 13, which are momentarily not covered by the belt, into the interior of pulley 11 and from there through the other perforations of shell 13 and through the air-pervious belt. Thereby, the belt seizes, by suction, a web or a tail 9 earlier than with a conventional vacuum belt conveyor having only solid pulleys. This favorable result may be further improved by marginal air blast nozzles 46 (FIG. 5). To tension the belt, pulley 11, upstream section 15*a* of box 15 and sealing elements 16 and 17 are commonly displaceable relative to downstream section 15*b* of box 15, as schematically illustrated by double arrow 'D' of FIG. 1. The guiding of pulley 11, upstream section 15*a,* and sealing elements 16 and 17 is accomplished by two bearing plates 19 (FIG. 2) which are rigidly connected to stationary downstream section 15*b* including cover plate 20 having suction openings 21.

Upstream section 15*a,* includes cover plate 22, made of ceramic or other low friction material, wherein suction slots 23 are provided which extend parallel to the traveling direction of the belt. Connected to plate 22 is a thin perforated sheet or runner 24 made of stainless steel or like material. Runner 24 slides on cover plate 20 when the belt is tensioned.

The negative pressure provided in upstream section 15*a* should be higher than the negative pressure provided in downstream section 15*b*. Various external or internal vacuum sources may be utilized as disclosed in patent application DE 100 09 188. As an alternative, the interior of suction pulley 11 may be connected to a vacuum source via a hollow journal of pulley 11. In order to drive the belt, one of the pulleys is connected to a motor. As an example, the second pulley, supported by downstream section 15*b,* may be driven by an internal motor as disclosed in DE 299 10 850.

Figure 3:
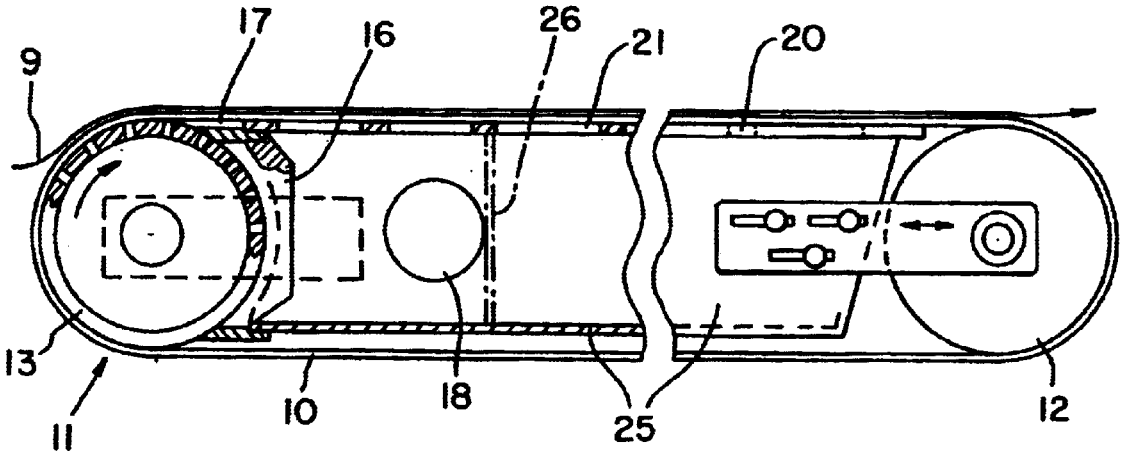
FIG. 3 is a side view of an alternative embodiment of the invention.

Referring additionally now to FIG. 3, the vacuum belt conveyor shown includes an air-pervious endless belt 10, a first pulley 11, a second pulley 12 and a vacuum box 25. A web or tail to be conveyed is shown at 9. First pulley 11 is formed as a suction pulley including a perforated rotary shell 13. In contrast to FIGS. 1 and 2, vacuum box 25 is formed as a single stationary piece including cover plate 20 having suction openings 21. Vacuum box 25 supports both first pulley 11 and second pulley 12; the latter being displaceable in order to tension belt 10. First pulley 11 is not displaceable relative to vacuum box 25.

Vacuum box 25 is open toward rotary shell 13 and, sealing elements 16 and 17 are provided. Vacuum created within box 25 propagates into first pulley 11 and through belt 10 so that tail 9 is forced by suction to cling to belt 10 at the periphery of suction pulley 11. If needed, the interior of vacuum box 25 may be subdivided by partition wall 26, so that next to suction pulley 11 a higher vacuum can be provided.

Figure 4:
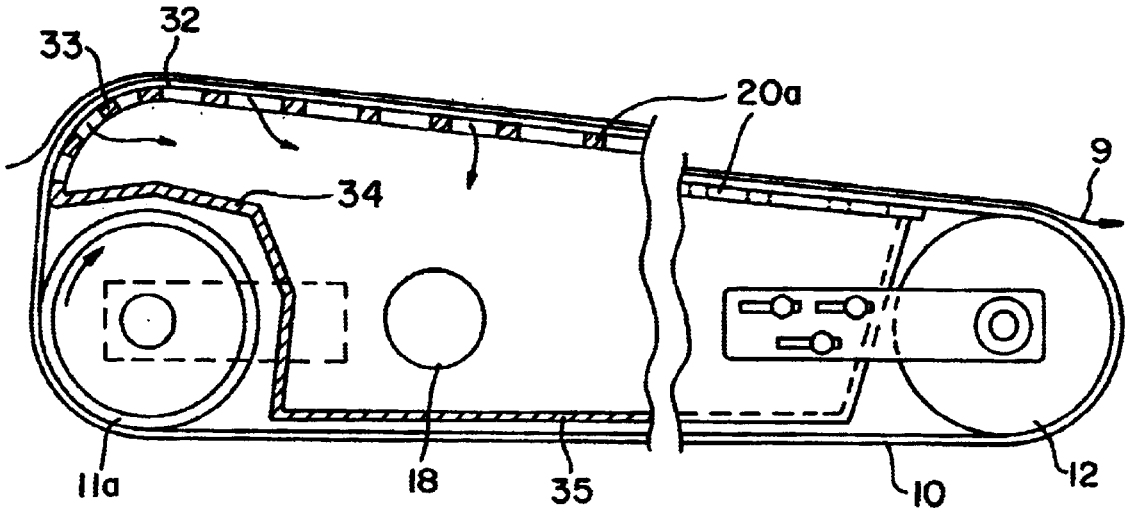
FIG. 4 is a side view of another alternative embodiment of the present invention.

Referring additionally now to FIG. 4, there is shown, a further variation of the above described vacuum belt conveyor. Similar to conventional conveyors, belt 10 travels across two solid pulleys 11*a* and 12 which are supported by one-piece vacuum box 35. In the area of the upstream end of the conveyor, there is a stationary, convexly curved and perforated guiding surface 32 for belt 10. Curved guiding surface 32 forms a curved suction area which serves the same purpose as suction pulley 11 of FIGS. 1–3.

Curved guiding surface 32 is formed as perforated curved plate 33 which may be an integral part of plane cover plate 20*a* of box 35 or may be separate from cover plate 20*a*. Curved guiding surface 32 is positioned somewhat oblique relative to the return run of belt 10. Vacuum box 35 includes or supports box section 34 which is wrapped around a part of first pulley 11*a* and which supports curved perforated plate 33.

Referring additionally now to FIG. 5, there is shown some details of a paper making machine including a last drying cylinder 40, dryer felt 41, felt roll 42, paper roll 43 and doctor 44. The normal travel path of the paper web is shown at 9A. During the threading process, the web first runs downward at 9B, then it is separated at arrow 45 being peeled from cylinder 40 by one or two marginal nozzles 46 (see FIG. 2) and immediately seized by first vacuum belt conveyor 8. Vacuum belt conveyor 8 transfers the web to second belt conveyor 8'. At least first conveyor 8 is designed according to the present invention.

Figure 6:
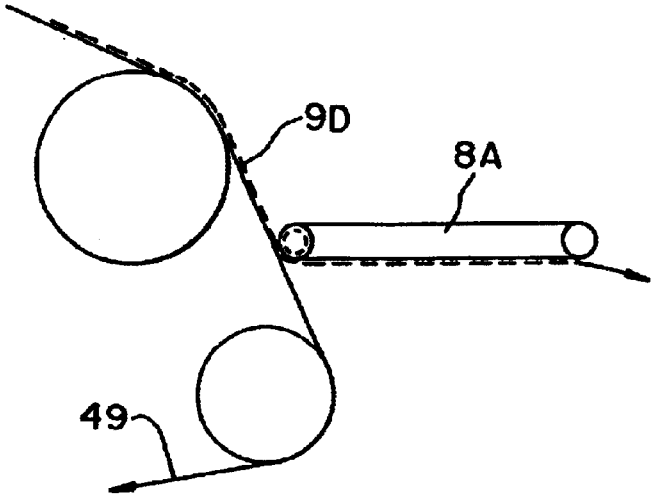
FIG. 6 illustrates another situation in a papermaking machine wherein a vacuum belt conveyor is provided.

Referring additionally now to FIG. 6, there is shown vacuum belt conveyor 8A which is designed according to the present invention. The upstream end of conveyor 8A contacts a felt or fabric 49 which supports traveling paper web 9D. Web 9D is directly transferred by contact onto the belt of conveyor 8A. In this arrangement, the bottom part of vacuum belt conveyor 8A is the conveying run.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vacuum belt conveyor, comprising:

an air-pervious endless belt;

a first pulley disposed at an upstream end of said conveyor and a second pulley disposed at a downstream end of said conveyor, said first pulley and said second pulley configured to guide said air-pervious endless belt, said air-pervious endless belt having a conveying run from said first pulley to said second pulley and a return run from said second pulley to said first pulley;

a plate having openings which are connected to a source of negative pressure, said plate being in contact with said air-pervious endless belt over at least a portion of said conveying run; and a curved perforated guiding surface being connected to the source of negative pressure, said guiding surface proximate to said upstream end, said air-pervious endless belt being in contact with said guiding surface.

2. The conveyor of claim 1, wherein said plate and said curved perforated guiding surface are connected to a common source of negative pressure.

3. A vacuum belt conveyor, comprising:

an air-pervious endless belt;

a first pulley disposed at an upstream end of said conveyor and a second pulley disposed at a downstream end of said conveyor, said first pulley and said second pulley configured to guide said air-pervious endless belt, said air-pervious endless belt having a conveying run from said first pulley to said second pulley and a return run from said second pulley to said first pulley;

a plate having openings which are connected to a source of negative pressure, said plate being in contact with said air-pervious endless belt over at least a portion of said conveying run; and a curved perforated guiding surface is formed as a rotary shell of said first pulley, said curved perforated guiding surface being connected to the source of negative pressure, said guiding surface proximate to said upstream end, said air-pervious endless belt being in contact with said guiding surface.

4. The conveyor of claim 3, further comprising:

a vacuum box disposed within a loop of said air-pervious endless belt, said vacuum box being open toward said rotary shell; and at least one sealing element connected to said vacuum box, said at least one sealing element being one of proximate to said rotary shell and in contact with said rotary shell.

5. The conveyor of claim 4, wherein said vacuum box is subdivided into at least two sections arranged one behind the other in a direction of travel of said air-pervious endless belt, one of said at least two sections being an upstream section and an other section being a downstream section.

6. The conveyor of claim 5, wherein said upstream section is open towards said rotary shell, said upstream section being supplied with a higher negative pressure than said downstream section.

7. The conveyor of claim 4, wherein at least one of said first pulley and said second pulley is configured to be displaceable for tensioning said air-pervious endless belt.

8. The conveyor of claim 7, wherein said second pulley is displaceable relative to said vacuum box.

9. The conveyor of claim 7, wherein said first pulley is supported by said vacuum box and said first pulley and said vacuum box are displaceable relative to a stationary element.

10. The conveyor of claim 9, wherein said vacuum box includes a downstream section defining said stationary element.

11. A vacuum belt conveyor, comprising:

an air-pervious endless belt;

a first pulley disposed at an upstream end of said conveyor and a second pulley disposed at a downstream end of said conveyor, said first pulley and said second pulley configured to guide said air-pervious endless belt, said air-pervious endless belt having a conveying run from said first pulley to said second pulley and a return run from said second pulley to said first pulley;

a plate having openings which are connected to a source of negative pressure, said plate being in contact with said air-pervious endless belt over at least a portion of said conveying run; and a curved perforated guiding surface is formed as a curved stationary plate, said curved perforated guiding surface being connected to the source of negative pressure, said guiding surface proximate to said upstream end, said air-pervious endless belt being in contact with said guiding surface.

12. A vacuum belt conveyor, comprising:

an air-pervious endless belt;

a first pulley disposed at an upstream end of said conveyor and a second pulley disposed at a downstream end of said conveyor, said first pulley and said second pulley configured to guide said air-pervious endless belt, said air-pervious endless belt having a conveying run from said first pulley to said second pulley and a return run from said second pulley to said first pulley;

a plate having openings which are connected to a source of negative pressure, said plate being in contact with said air-pervious endless belt over at least a portion of said conveying run;

a curved perforated guiding surface being connected to the source of negative pressure, said guiding surface proximate to said upstream end, said air-pervious endless belt being in contact with said guiding surface; and at least one marginal nozzle disposed at said upstream end of said conveyor, said marginal nozzle configured to emit an air jet between a web delivering roll and one of a web and a tail, to urge one of said web and said tail onto said upstream end of said conveyor.

13. The conveyor of claim 12, wherein said at least one marginal nozzle is configured to urge a new beginning of one of said web and said tail onto said upstream end of said conveyor.

* * * * *